US005217080A

United States Patent [19]

Wenzel et al.

[11] Patent Number: 5,217,080

[45] Date of Patent: Jun. 8, 1993

[54] SEALING SYSTEM FOR A SEALED BEARING ASSEMBLY

[76] Inventors: Kenneth H. Wenzel, 147 Knottwood Road North, Edmonton, Alberta, Canada, T6K 4B8; Dean Foote, 4128 - 147 Street, Edmonton, Alberta, Canada, T6H 5V1

[21] Appl. No.: 767,862

[22] Filed: Sep. 30, 1991

[30] Foreign Application Priority Data

Jan. 8, 1991 [CA] Canada ..... 2033779

[51] Int. Cl.[5] ..... E21B 4/02

[52] U.S. Cl. ..... 175/107; 175/215; 384/95

[58] Field of Search ..... 175/107, 76, 337

[56] References Cited

U.S. PATENT DOCUMENTS

| | | | |
|---|---|---|---|
| 4,114,702 | 9/1978 | Maurer | 175/107 |
| 4,114,703 | 9/1978 | Matson, Jr. et al. | 175/107 |
| 4,114,704 | 9/1978 | Maurer et al. | 175/107 |
| 4,324,299 | 4/1982 | Nagel | 175/107 |
| 4,361,194 | 10/1982 | Chow et al. | 175/102 |
| 4,410,054 | 10/1983 | Nagel et al. | 175/107 |
| 4,577,704 | 3/1986 | Aumann | 175/107 |
| 4,620,601 | 11/1986 | Nagel | 175/107 |
| 4,683,964 | 8/1987 | Wenzel | 175/107 |
| 4,772,246 | 9/1988 | Wenzel | 464/117 |

FOREIGN PATENT DOCUMENTS

| | | | |
|---|---|---|---|
| 1224456 | 7/1987 | Canada | 255/12 |
| 1234385 | 3/1988 | Canada | 255/12 |

*Primary Examiner*—Ramon S. Britts
*Assistant Examiner*—Frank S. Tsay
*Attorney, Agent, or Firm*—Beveridge, DeGrandi, Weilacher & Young

[57] ABSTRACT

An improved sealing system for a sealed bearing assembly used in earth drilling. The bearing assembly has a first tubular member, and a second tubular member telescopically received in the first tubular member. The second tubular member has an interior passage through which drilling fluids pass under pressure from on surface pumps. A clearance space is provided between the first tubular and the second tubular member defining a lubricant filled bearing chamber. The improvement is in the seal at a pump end of the bearing chamber which consists of a first floating piston, a second floating piston spaced from the first floating piston, and a fixed seal intermediate the first floating piston and the second floating piston. A first chamber is provided between the first floating piston and the fixed seal. The first chamber is filled with lubricant. A second chamber is provided between the fixed seal and the second floating piston. The chamber has a passage to external of the first tubular member. The differential in pressure between the first chamber and the second chamber is sealed by the fixed seal.

5 Claims, 3 Drawing Sheets

SEALING SYSTEM FOR A SEALED BEARING ASSEMBLY

The present invention relates to an improved sealing system for a sealed bearing assembly used in earth drilling.

BACKGROUND OF THE INVENTION

A factor which limits the useful life of sealed bearing assemblies used with downhole motors for earth drilling is seal failure. Once the seals of a bearing assembly fail, abrasive drilling fluids enter the bearings. In order to prolong seal life one skilled in the art attempts, insofar as is possible, to balance the pressures acting upon each seal and provide for a backup seal in the event of seal failure. As the sealing systems are improved, the useful life of the bearing assemblies are extended.

SUMMARY OF THE INVENTION

The present invention relates to a sealed bearing assembly with a novel and inventive sealing system which has means for balancing, insofar as is possible, the pressures exerted upon individual seals while providing back up seals in the event of seal failure.

According to the present invention there is provided an improved sealing system for a sealed bearing assembly used in earth drilling. The prior art bearing assemblies have a first tubular member, and a second tubular member telescopically received in the first tubular member. The second tubular member has an interior passage through which drilling fluids pass under pressure from on surface pumps. A clearance space is provided between the first tubular and the second tubular member defining a lubricant filled bearing chamber. A plurality of radial bearings are disposed in the bearing chamber, thereby facilitating relative rotation between the first tubular member and the second tubular member. At least one thrust bearing is disposed in the bearing chamber. The bearing chamber has a bit end which faces the drill bit and a pump end which faces on surface pumps. Sealing means are disposed at the drill bit end and the pump end of the bearing chamber. The sealing means at the pump end of the bearing chamber are exposed to a flow of drilling fluids. The improvement is in the sealing means at the pump end of the bearing chamber which is comprised of a first floating piston, a second floating piston spaced from the first floating piston, and a fixed seal intermediate the first floating piston and the second floating piston. A first chamber is provided between the first floating piston and the fixed seal. The first chamber is filled with lubricant. Drilling fluids exert a force to move the first piston compressing the lubricant in the first chamber until the pressure in the first chamber is equal to the pressure exerted by the drilling fluids passing through the interior passage. A second chamber is provided between the fixed seal and the second floating piston. The chamber has a passage to external of the first tubular member whereby drilling fluids passing externally of the first tubular member are brought in fluid communication with the second chamber. The drilling fluids exert a force to move the second piston compressing the lubricant in the bearing chamber until the pressure in the bearing chamber is equal to the pressure exerted by drilling fluids brought from external of the first tubular member into the second chamber. The differential in pressure between the first chamber and the second chamber is sealed by the fixed seal.

If the fixed seal should fail after prolonged use or as a result in an increase in the pressure differential which exceeds its capacity, the lubricant in the first chamber will leak. As the lubricant leaks from the first chamber the first piston will move into a position resting against and assuming the function of the fixed seal in sealing the pressure differential.

Although beneficial results may be obtained through the use of the sealing system as described, it is known in the art that a mechanical seal can withstand a pressure differential far beyond the capacity of an elastomer seal in a rotary sealing application. The additional problem posed is how to configure the fixed seal to accommodate a mechanical seal. Even more beneficial results may, therefore, be obtained by having a fixed seal which is comprised of a first seal ring non-rotatably coupled to the first tubular member, and a second seal ring non-rotatably coupled to the second tubular member. Means are provided to bring the first seal ring and the second seal ring into sealing engagement thereby forming a mechanical seal. The mechanical seal has a first side in fluid communication with the first chamber and a second side in fluid communication with the second chamber.

There are a number of ways of fixing the first seal ring to the first tubular member and the second seal ring to the second tubular member. The Applicant prefers the fixed seal to be comprised of a first annular member having a first seal ring mounted thereto, and a second annular member having a second seal ring mounted thereto. The first annular member has an interior bore in which the second tubular member is telescopically received. The first annular member has a tapered exterior profile which engages a mating tapered profile on an interior surface of the first tubular member to non-rotatably couple the first annular member with the first tubular member. The second annular member has an interior bore in which the second tubular member is telescopically received. The interior bore of the second annular member has a plurality of axially extending grooves. Each of the grooves have opposed side walls and a top wall inwardly inclined toward the second tubular member. A roller pin is disposed in each of the grooves. The rotation of the second tubular member results in the roller pin rolling into a position wherein it becomes wedged between the inclined top wall of the groove and the second tubular member, thereby non-rotatably coupling the second annular member to the second tubular member. A spring is disposed between one of the annular members and one of the seal rings thereby providing a biasing force to bring the seal rings into engagement such that a mechanical seal is formed. The mechanical seal has a first side in fluid communication with the first chamber and a second side in fluid communication with the second chamber.

Although beneficial results may be obtained through the use of the sealing system as described, wear can occur between the first annular member and second annular member. Even more beneficial results may, therefore be obtained, by having a plurality of bearings disposed between the first annular member and the second annular member.

Although beneficial results may be obtained through the use of the sealing system as described, even more beneficial results may be obtained by having the first annular member and the second annular member secured together to form a cartridge.

The use of a cartridge facilitates the replacement of the fixed seal. The fixed seal may be replaced by a technician under field conditions, if necessary.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENT

Figure 1:
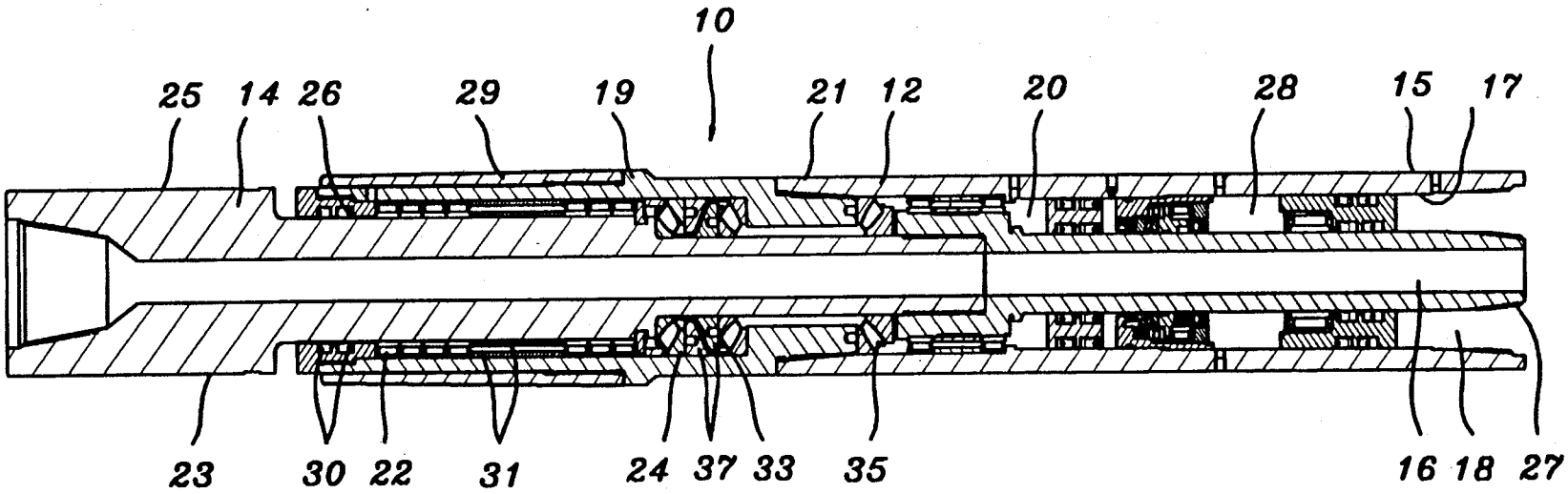
FIG. 1 is a longitudinal section view of a bearing assembly constructed in accordance with the teachings of the invention.

The preferred embodiment, an improved sealing system for a bearing assembly used in earth drilling generally identified by reference numeral 10, will now be described with reference to FIGS. 1 through 3.

In order to assist in distinguishing the present invention from the prior art, that portion of the bearing assembly 10 which is known in the art will be described first. Referring to FIG. 1, bearing assembly 10 consists of a first tubular member 12 and a second tubular member 14. First tubular member has an exterior surface 15 and an interior surface 17. In the embodiment illustrated first tubular member 12 comes in two threadedly connected sections 19 and 21. Second tubular member 14 is telescopically received in first tubular member 12. Second tubular member 14 has an interior passage 16 through which drilling fluids pass under pressure from on surface pumps (not shown). Second tubular member has an exterior surface 23. In the embodiment illustrated second tubular member 14 comes in two threadedly connected sections 25 and 27. An external sleeve 29 attaches to section 25. A clearance space 18 is provided between first tubular 12 and second tubular member 14 which assists in defining a lubricant filled bearing chamber 20. Clearance space 18 is bounded by interior surface 17 of first tubular member 12 and exterior surface 23 of second tubular member 14. A plurality of radial bearings 22 are disposed in bearing chamber 20. Sets of radial bearings 22 are separated by spacer sleeves 31. Radial bearings 22 facilitate the relative rotation between first tubular member 12 and second tubular member 14. A plurality of thrust bearing 24, 33 and 35 are also disposed in bearing chamber 20, to withstand axial loads Thrust bearings 24 and 33 take compressions loads. Spacer sleeves 37 are disposed between thrust bearings 24 and 33 to distribute the load between them. Thrust bearing 35 takes tension loads. For the purpose of this description bearing chamber 20 can be considered to have a bit end 26 which faces the drill bit (not shown) and a pump end 28 which faces on surface pumps (not shown). Seals 30 are positioned at drill bit end 26 of bearing chamber 20. The sealing means at pump end 28 of bearing chamber 20 has been improved and will hereinafter be described in more detail. It must be noted that the sealing means at pump end 28 of bearing chamber 20 is exposed to a flow of drilling fluids.

Figure 2:
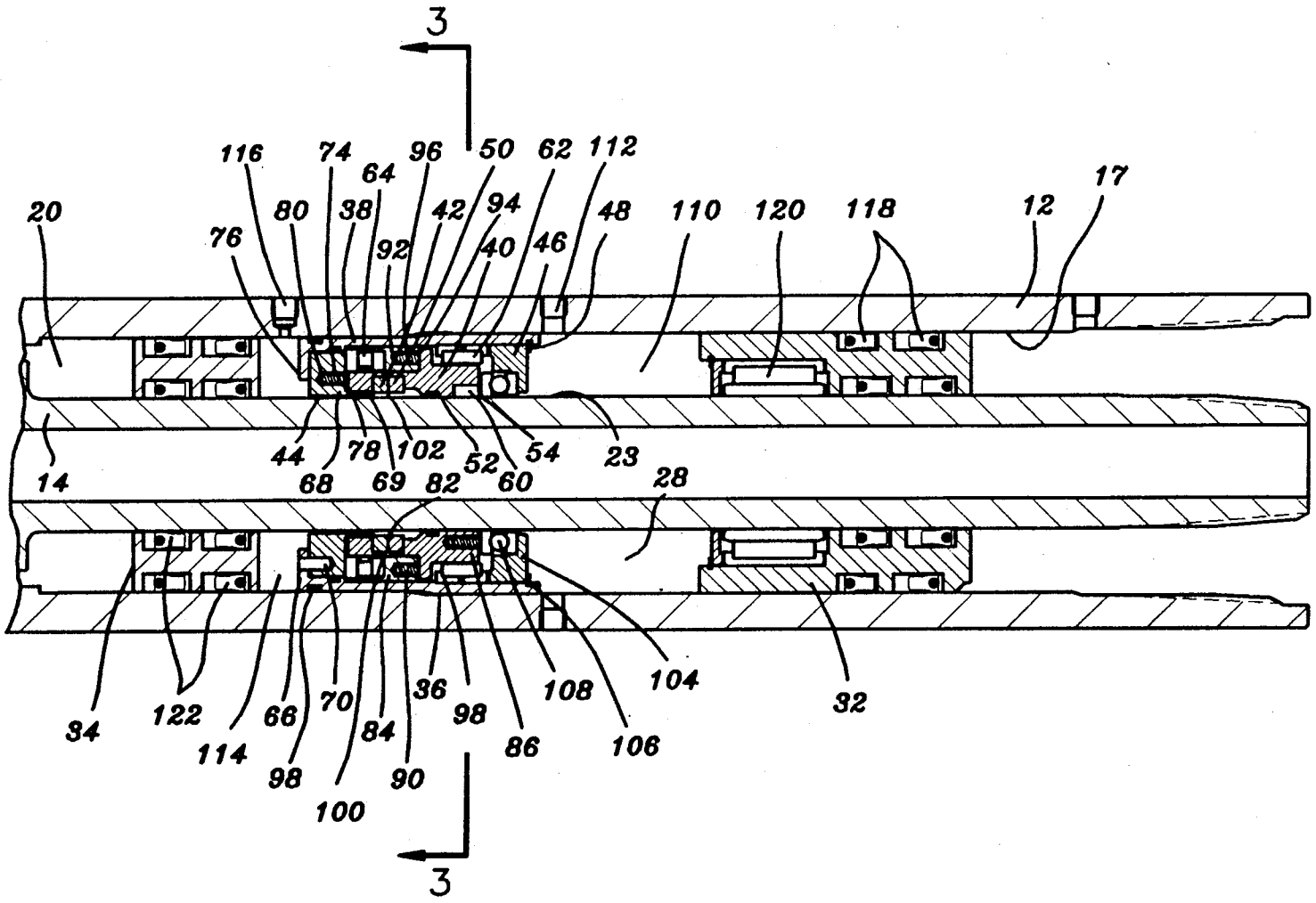
FIG. 2 is a detailed view of a portion of the bearing assembly illustrated in FIG. 1.
Figure 3:
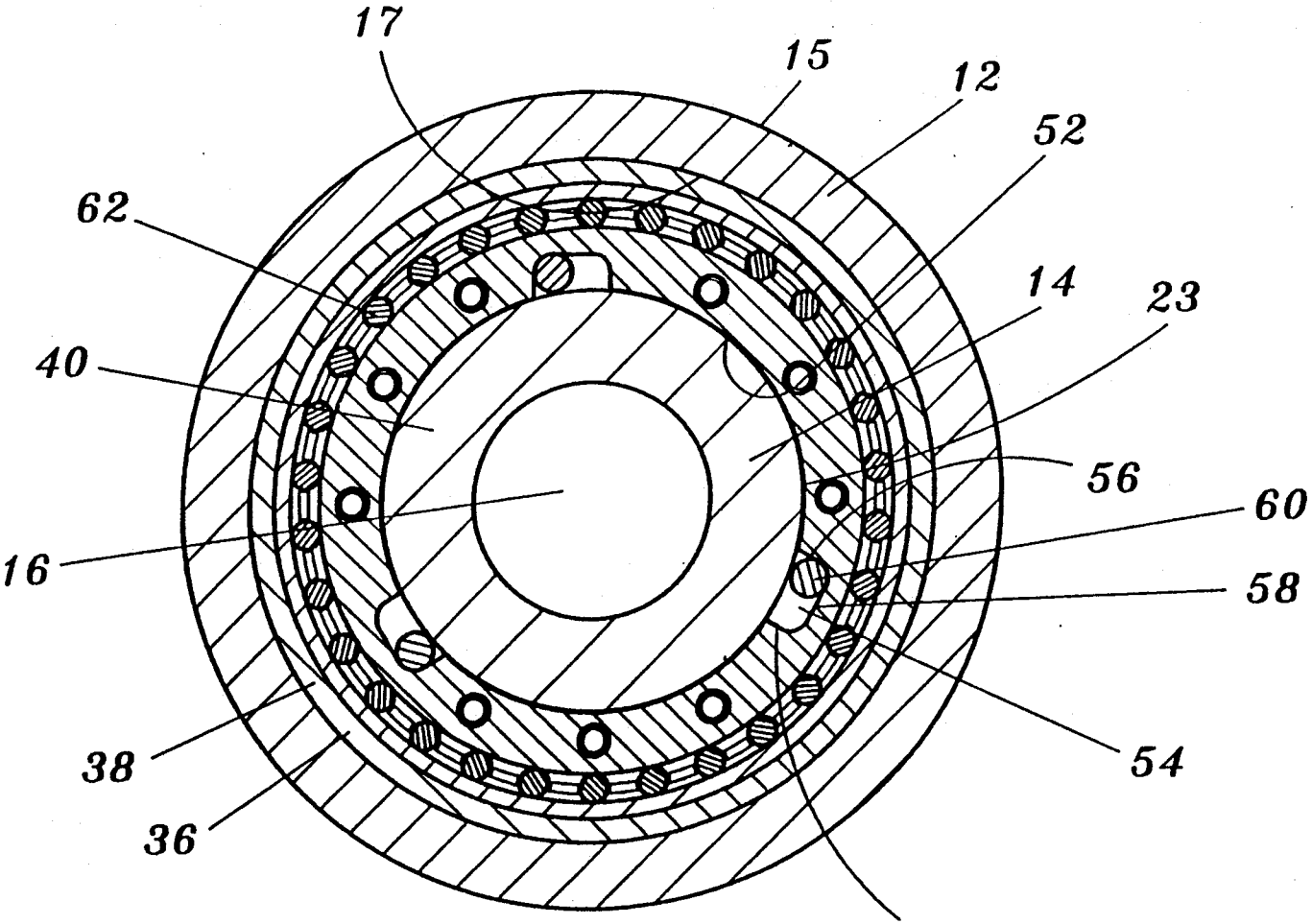
FIG. 3 is a transverse section taken along section lines 3—3 of FIG. 2.

Referring to FIG. 2, the sealing means at pump end 28 of bearing chamber 20 will now be described. The primary components are a first floating piston 32, a second floating piston 34 and a fixed seal 36. First floating piston is closest to pump end 28 of bearing chamber 20. Second floating piston 34 is spaced from first floating piston toward drill bit end 26 of bearing chamber 20. Fixed seal 36 is positioned intermediate first floating piston 32 and second floating piston 34. Fixed seal 36 consists of a first annular member 38 and a second annular member 40. First annular member 38 has a first seal ring 42 mounted thereto, First annular member 38 has an interior bore 44 in which second tubular member 14 is telescopically received. The first annular member 38 has a portion 46 with a tapered exterior profile which engages a portion 48 with a mating tapered profile on interior surface 17 of first tubular member 12 to non-rotatably couple first annular member 38 with first tubular member 12. Second annular member 40 has a second seal ring 50 mounted thereto. Second annular member 40 has an interior bore 52 in which second tubular member 14 is telescopically received Interior bore 52 of second annular member 40 has a plurality of axially extending grooves 54. Each of grooves 54 have opposed side walls 56 and a top wall 58 inwardly inclined toward exterior surface 23 of second tubular member 14. A roller pin 60 is disposed in each of grooves 54. The rotation of second tubular member 14 results in roller pin 60 rolling into a position where it becomes wedged between inclined top wall 58 of groove 54 and exterior surface 23 of second tubular member 14, thereby non-rotatably coupling second annular member 40 to second tubular member 14. Bearings 62 and 64 are disposed between first annular member 38 and second annular member 40. Bearing 62 maintains the radial spacing and helps keep second tubular member 14 running "true". Bearing 64 maintains axial spacing. In the illustrated embodiment, first annular member 38 consists of components 66, 68 and 69. Dowel pins 70 are used to non-rotatably couple component 66 to component 68. Dowel pins (not shown) are used to non-rotatably couple component 69 to component 68. A plurality of springs 74 are provided having a first end 76 and a second end 78. A plurality of pockets 80 are provided in component 68 of first annular member 38. First end 78 of each of springs 74 is disposed in one of pockets 80. Second end 76 of each of springs 74 exerts a biasing force upon component 69 which brings first seal ring 42 into face to face engagement with second seal ring 50 such that a mechanical seal, generally identified by reference numeral 82, is formed. In the illustrated embodiment, second annular member 40 consists of components 84, and 86. A plurality of springs 90 are provided having a first end 92 and a second end 94. A plurality of pockets 96 are provided in component 84. First end 92 of each of springs 90 is disposed in one of pockets 96. Second end 94 of each of springs 90 exerts a biasing force upon component 86 bringing component 84 into engagement with bearing 64. A plurality of 0 ring seals 98 are provided 0 ring seals 98 are used to prevent fluid flow between first tubular member 12 and first annular member 38, between second tubular member 14 and second annular member 40, between the respective components of first annular member 38 and between the respective components of second annular member 40. Fluids can flow between first annular member 38 and second annular member 40 from either end coming into communication with either first side 100 or second side 102 of mechanical seal 82. In the illustrated embodiment, first annular member 38 and second annular member 40 are secured together to turn fixed seal 36 into a form of a replaceable cartridge. This is accomplished through the addition of a third annular member 104 fits within component 66 of first annular member and is secured thereto with a snap ring 106. A bearing 108 is disposed between third annular member 104 and second annular member 40. Springs 90 ensure that a load is always upon bearing 108. With third annular member 104 secured in place by snap ring 106, first annular member 38, second annular member 40 and third annular member 104 are removable as a complete unit or "cartridge".

A first chamber 110 is positioned between first floating piston 32 and fixed seal 36. First chamber 110 is filled with lubricant through port 112 which has a removable plug (not shown). A second chamber 114 is provided between fixed seal 36 and second floating piston 34. Second chamber 114 has a passage 116 to exterior surface 15 of first tubular member 12. First side 100 of mechanical seal 82 is in fluid communication with first chamber 110. Second side 102 of mechanical seal 82 is in fluid communication with second chamber 114. First floating piston 32 has a plurality of seals 118, and a bearing 120. Second floating piston 34 has a plurality of seals 122.

In order to place the significance of the present invention in context the description of the use and operation of bearing assembly 10 will be preceded with a description of the sealing system used in the prior art. The flow of drilling fluids is always down through interior passage 16 of second tubular member 14 and then up exterior surface 15 of first tubular member 12. In the prior art a flow of drilling fluids exerted a force upon a single floating piston positioned at pump end 28 of bearing chamber 20. This served to place lubricant in bearing chamber 20 under the same pressure as exerted by drilling fluids flowing through interior passage 16. Any pressure differential between the drilling fluids in interior passage 16 and drilling fluids flowing along exterior surface 15 of first tubular member 12 was borne by elastomer seals 30 positioned at drill bit end 26 of bearing chamber 20. Seals 30 were always placed in series, in order that a backup seal would be in position in the event of seal failure.

The background in the prior art having been given, the use and operation of bearing assembly 10 will now be described with reference to FIGS. 1 through 3. In bearing assembly 10 drilling fluids exert a force to move first piston 32 compressing lubricant in first chamber 110 until the pressure in first chamber 110 is equal to the pressure exerted by drilling fluids passing through interior passage 16. Drilling fluids passing along exterior surface 15 of first tubular member 12 are brought in fluid communication with second chamber 114 through open passage 116. Drilling fluids in second chamber 114 exert a force to move second piston 34 compressing lubricant in bearing chamber 20 until the pressure in bearing chamber 20 is equal to the pressure exerted by drilling fluids passing along exterior surface 15 of first tubular member 12 and entering second chamber 114 through passage 116. Seals 30 are thereby pressure balanced as the pressure exerted from drilling fluids passing along exterior surface 15 of first tubular member and the pressure exerted by lubricant in bearing chamber 20 is the same. There is, however, a differential between the pressure in first chamber 110 and the pressure in second chamber 114. This differential in pressure is sealed by fixed seal 36. In the illustrated embodiment fixed seal 36 is a mechanical seal 82 consisting of first seal ring 42 and second seal ring 50. First seal ring 42 is secured to first annular member 38. Due to the "taper lock" formed by the mating of portion 46 of first annular member 38 with portion 48 on interior surface 17 of first tubular member 12, first annular member 38 moves with first tubular member 12. Second seal ring 50 is secured to second annular member 40. Due to the wedging of roller pins 60 between inclined top wall 58 of grooves 54 and exterior surface 23 of second tubular member 14, second annular member 40 moves with second tubular member 14. It can be seen that with relative rotation of first tubular member 12 and second tubular member 14 there is relative movement of first seal ring 42 and second seal ring 50. Lubricant, preferably oil, from first chamber 110 communicates with first side 100 of mechanical seal 82. Drilling fluids from second chamber 114 communicate with second side 102 of mechanical seal 82. All other paths for the passage of fluids are sealed by 0 ring seals 98. If first seal ring 42 and second seal ring 50 are not maintained in engagement oil will seep from first chamber 110 until that oil reservoir is exhausted. Springs 74 provide a biasing force which brings first seal ring 42 and second seal ring 50 into engagement. Conversely, if the pressure forcing first seal ring 42 and second seal ring 50 into engagement is too great all oil will be forced from between them and heat will be generated upon the relative rotation of first seal ring 42 and second seal ring 50. Bearing 64 assists in ensuring the force upon first seal ring 42 and second seal ring 50 is not too great, as without bearing 64 these faces could become overloaded squeezing all lubricant from between them. The pressure in first chamber 110 will always be greater than the pressure in second chamber 114 due to the force exerted by drilling fluids against first floating piston 32. First chamber 110, therefore, provides a reservoir of oil to facilitate the operation of mechanical seal 82. In normal operation mechanical seal 82 will leak oil between first seal ring 42 and second seal ring 50 to second chamber 114. This leakage is viewed as desirable as it ensures that lubricant is always between the faces of the seals. First chamber 110 provides a reservoir of oil. The leakage of oil is so slight that the quantity of oil in first chamber 110 is more than adequate for the number of hours the tool is in operation. If mechanical seal 82 should totally fail, the oil in first chamber 110 is quickly depleted, and first piston 32 moves into position against fixed seal 36 and serves a backup role as a fixed seal.

It can be seen from this description that the use of a two floating pistons with a fixed seal disposed in between provides an improved method of pressure balancing the seals while providing an improved backup position in the event the fixed seal which must withstand the pressure differential fails. It can also be seen that the seal configuration permits the use of a mechanical seal and provides a reservoir of oil for the operation of the mechanical seal. For purposes of maintenance, the entire fixed seal 36 can be easily removed by simply withdrawing it from the described "taper lock", and replacing it with a new "cartridge". This greatly reduces maintenance down time and makes possible servicing "on site" if desired. Once a new cartridge has been placed in position, the oil reservoir in first chamber 110 is replenished through fill port 112.

It will be apparent to one skilled in the art that modifications may be made to the illustrated embodiment without departing from the spirit and scope of the invention as defined in the claims. Many of the features illustrated are non-essential, but only reflect the best mode of construction presently known to the Applicants. For example, the bearings illustrated could be replaced with bushings. The configuration would be an improvement over the prior art even if an elastomer seal were used in place of mechanical seal 82. There are a variety of alternate ways to secure first annular member 38 and second annular member 40 in position. If fixed seal 36 was to be an elastomer seal the construction of fixed seal 36 need not be as elaborate.

The embodiments of the invention in which an exclusive property or privilege is claimed are defined as follows:

1. An improved sealing system for a bearing assembly used in earth drilling having a first tubular member, a second tubular member telescopically received in the first tubular member, the second tubular member having an interior passage through which drilling fluids pass under pressure from on surface pumps, a clearance space between the first tubular and the second tubular member defining a lubricant filled bearing chamber, a plurality of radial bearings disposed in the bearing chamber, thereby facilitating relative rotation between the first tubular member and the second tubular member, at least one thrust bearing disposed in the bearing chamber, the bearing chamber having a bit end which faces the drill bit and a pump end which faces on surface pumps, sealing means being disposed at the drill bit end and the pump end of the bearing chamber, the sealing means at the pump end of the bearing chamber being exposed to a flow of drilling fluids, the sealing means at the pump end of the bearing chamber comprising:

a. a first floating piston;

b. a second floating piston spaced from the first floating piston;

c. a fixed seal intermediate the first floating piston and the second floating piston;

d. a first chamber between the first floating piston and the fixed seal, the first chamber being filled with lubricant such that drilling fluids exert a force to move the first piston compressing the lubricant in the first chamber until the pressure in the first chamber is equal to the pressure exerted by the drilling fluids passing through the interior passage;

e. a second chamber between the fixed seal and the second floating piston, the chamber having a passage to external of the first tubular member whereby drilling fluids passing externally of the first tubular member are brought in fluid communication with the second chamber, such that the drilling fluids exert a force to move the second piston compressing the lubricant in the bearing chamber until the pressure in the bearing chamber is equal to the pressure exerted by drilling fluids brought from external of the first tubular member into the second chamber, the differential in pressure between the first chamber and the second chamber being sealed by the fixed seal; and f. the fixed seal comprising:

i. a first seal ring non-rotatably coupled to the first tubular member;

ii. a second seal ring disposed parallel to the first seal ring non-rotatably coupled to the second tubular member; and iii. means to bring the first seal ring and the second seal ring into sealing engagement thereby forming a mechanical seal, the mechanical seal having a first side in communication with the first chamber and a second side in communication with the second chamber.

2. An improved sealing system for a bearing assembly used in earth drilling having a first tubular member, a second tubular member telescopically received in the first tubular member, the second tubular member having an interior passage through which drilling fluids pass under pressure from on surface pumps, a clearance space between the first tubular and the second tubular member defining a lubricant filled bearing chamber, a plurality of radial bearings disposed in the bearing chamber, thereby facilitating relative rotation between the first tubular member and the second tubular member, at least one thrust bearing disposed in the bearing chamber, the bearing chamber having a bit end which faces the drill bit and a pump end which faces on surface pumps, sealing means being disposed at the drill bit end and the pump end of the bearing chamber, the sealing means at the pump end of the bearing chamber being exposed to a flow of drilling fluids, the sealing means at the pump end of the bearing chamber comprising:

a. a first floating piston;

b. a second floating piston spaced from the first floating piston;

c. a fixed seal intermediate the first floating piston and the second floating piston;

d. a first chamber between the first floating piston and the fixed seal, the first chamber being filled with lubricant such that drilling fluids exert a force to move the first piston compressing the lubricant in the first chamber until the pressure in the first chamber is equal to the pressure exerted by the drilling fluids passing through the interior passage;

e. a second chamber between the fixed seal and the second floating piston, the chamber having a passage to external of the first tubular member whereby drilling fluids passing externally of the first tubular member are brought in fluid communication with the second chamber, such that the drilling fluids exert a force to move the second piston compressing the lubricant in the bearing chamber until the pressure in the bearing chamber is equal to the pressure exerted by drilling fluids brought from external of the first tubular member into the second chamber, the differential in pressure between the first chamber and the second chamber being sealed by the fixed seal; and f. a first annular member having a first seal ring mounted thereto, the first annular member having an interior bore in which the second tubular member is telescopically received, the first annular member having a tapered exterior profile which engages a mating tapered profile on the first tubular member to non-rotatably couple the first annular member with the first tubular member;

g. a second annular member having a second seal ring mounted thereto disposed parallel to the first seal ring, the second annular member having an interior bore in which the second tubular member is telescopically received, the interior bore of the second annular member having a plurality of axially extending grooves, each of the grooves having opposed side walls and a top wall inwardly inclined toward the second tubular member, a roller pin being disposed in each of the grooves, such that the rotation of the second tubular member results in the roller pin rolling into a position wherein it becomes wedged between the inclined top wall of the groove and the second tubular member, thereby non-rotatably coupling the second annular member to the second tubular member; and h. a spring disposed between one of the annular members and one of the seal rings thereby providing a biasing force to bring the seal rings into engagement such that a mechanical seal is formed, the mechanical seal having a first side in communication with the first chamber and a second side in communication with the second chamber.

3. The improved sealing system as defined in claim 2, having a plurality of bearings disposed between the first annular member and the second annular member.

4. The improved sealing system as defined in claim 3, the first annular member and the second annular member being secured together to form a cartridge, thereby facilitating the replacement of the fixed seal.

5. An improved sealing system for a bearing assembly used in earth drilling having a first tubular member, a second tubular member telescopically received in the first tubular member, the second tubular member having an interior passage through which drilling fluids pass under pressure from on surface pumps, a clearance space between the first tubular and the second tubular member defining a lubricant filled bearing chamber, a plurality of radial bearings disposed in the bearing chamber, thereby facilitating relative rotation between the first tubular member and the second tubular member, at least one thrust bearing disposed in the bearing chamber, the bearing chamber having a bit end which faces the drill bit and a pump end which faces on surface pumps, sealing means being disposed at the drill bit end and the pump end of the bearing chamber, the sealing means at the pump end of the bearing chamber being exposed to a flow of drilling fluids, the sealing means at the pump end of the bearing chamber comprising:

a. a first floating piston;

b. a second floating piston spaced from the first floating piston;

c. a fixed seal intermediate the first floating piston and the second floating piston, the fixed seal comprising:

i. a first annular member having a first seal ring mounted thereto, the first annular member having an interior bore in which the second tubular member is telescopically received, the first annular member having a tapered exterior profile which engages a mating tapered profile on the first tubular member to non-rotatably couple the first annular member with the first tubular member;

ii. a second annular member having a second seal ring mounted thereto disposed parallel to the first seal, the second annular member having an interior bore in which the second tubular member is telescopically received, the interior bore of the second annular member having a plurality of axially extending grooves, each of the grooves having opposed side walls and a top wall inwardly inclined toward the second tubular member, a roller pin being disposed in each of the grooves, such that the rotation of the second tubular member results in the roller pin rolling into a position wherein it becomes wedged between the inclined top wall of the groove and the second tubular member, thereby non-rotatably coupling the second annular member to the second tubular member;

iii. a plurality of bearings disposed between the first annular member and the second annular member;

iv. a spring disposed between the first annular member and the first seal rings thereby providing a biasing force to bring the first seal ring into engagement with the second seal ring such that a mechanical seal is formed, the mechanical seal having a first side in communication with the first chamber and a second side in communication with the second chamber; and v. the first annular member and the second annular member being secured together to form a cartridge, thereby facilitating the replacement of the fixed seal;

d. a first chamber between the first floating piston and the fixed seal, the first chamber being filled with lubricant such that drilling fluids exert a force to move the first piston compressing the lubricant in the first chamber until the pressure in the first chamber is equal to the pressure exerted by the drilling fluids passing through the interior passage;

e. a second chamber between the fixed seal and the second floating piston, the chamber having a passage to external of the first tubular member whereby drilling fluids passing externally of the first tubular member are brought in fluid communication with the second chamber, such that the drilling fluids exert a force to move the second piston compressing the lubricant in the bearing chamber until the pressure in the bearing chamber is equal to the pressure exerted by drilling fluids brought from external of the first tubular member into the second chamber, the differential in pressure between the first chamber and the second chamber being sealed by the fixed seal.

* * * * *